US005333878A

United States Patent [19]

Calhoun

[11] Patent Number: 5,333,878

[45] Date of Patent: Aug. 2, 1994

[54] MAZE TYPE BOARD GAME

[76] Inventor: Christopher A. Calhoun, 14513 Old Courthouse Way #8, Newport News, Va. 23602

[21] Appl. No.: 142,903

[22] Filed: Oct. 25, 1993

[51] Int. Cl.[5] ..... A63F 3/00

[52] U.S. Cl. ..... 273/283; 273/275

[58] Field of Search ..... 273/242, 243, 248, 249, 273/258, 275, 282.1, 283

[56] References Cited

U.S. PATENT DOCUMENTS

| | | | |
|---|---|---|---|
| 3,025,063 | 3/1959 | Magee . | |
| 3,309,092 | 3/1967 | Hardesty et al. . | |
| 3,768,811 | 10/1973 | Goldfarb . | |
| 4,004,810 | 1/1977 | Henrie . | |
| 4,057,253 | 11/1977 | Csoka . | |
| 4,252,320 | 2/1981 | Rouse | 273/243 |
| 4,453,718 | 6/1984 | Christoperson | 273/249 |
| 4,465,280 | 8/1984 | Dimitris | 273/153 R |
| 4,465,283 | 8/1984 | Pilette | 273/249 |
| 4,511,143 | 4/1985 | Sankrithi | 273/275 X |
| 4,534,567 | 8/1985 | Ferris | 273/255 |
| 4,614,344 | 9/1986 | O'Connor | 273/283 |
| 4,647,049 | 3/1987 | Oretsky et al. | 273/282.1 X |
| 4,674,753 | 6/1987 | Hochstim | 273/283 X |
| 4,728,107 | 3/1988 | Dvorak et al. | 273/275 X |
| 4,741,539 | 5/1988 | Sutton et al. | 273/275 |
| 4,817,957 | 4/1989 | Reeves | 273/248 |
| 5,108,109 | 4/1992 | Leban | 273/275 X |
| 5,108,111 | 4/1992 | Bilodeau | 273/249 |

OTHER PUBLICATIONS

"Falcon's Maze", *Games*, Jul. 1988 p. 41.

*Primary Examiner*—William E. Stoll

[57] ABSTRACT

A maze type board game comprising a game board (17) having a plurality of maze areas (22) and segments interconnected between maze areas comprising a plurality of spaces which include: movement spaces (19), starting spaces (20) and transport spaces (18), at least one separate movable search piece (16) for each player, and a plurality of maze walls (12) for disposition on the game board, the spaces and maze walls having cooperative dimensions such that a plurality of maze walls are required to define a maze on the game board. The game is played in an attempt by one player to find the marked orb(s) (15) hidden among decoy orb(s) (14) of another player while the player, whose marked orb(s) is/are being searched for, places maze walls to delay or prevent other player(s) from finding the marked orb(s) thus forming a maze that must have at least one entrance and path leading to every marked orb in that maze area from the interconnected segments between the maze areas.

19 Claims, 3 Drawing Sheets

MAZE TYPE BOARD GAME

BACKGROUND—FIELD OF INVENTION

This invention relates to a board game. Specifically, this invention relates to a board game wherein a player must find specially marked pieces as a maze is being defined on a game board.

BACKGROUND—DESCRIPTION OF PRIOR ART

There are many types of maze board games known. There have been several different approaches to these games. In some maze games, such as shown in U.S. Pat. No. 3,712,617 to OHLSCHLAGER and U.S. Pat. No. 3,025,063 to MAGEE, have partitions or maze walls which are movable before the game starts or during play. Some known maze board games have gates which move or the game board itself changes to form different paths for search pieces to move through, such as shown in U.S. Pat. No. 4,817,957 to REEVES, U.S. Pat. No. 4,465,280 to DIMITRIU, U.S. Pat. No. 4,453,718 to CHRISTOPERSON, and U.S. Pat. No. 3,731,934 to SHOPTAUGH. Considering the maze type games, one will generally find that there is often a single or primary pathway from the start to the finish whether seen or unseen as shown in U.S. Pat. No. 4,057,253 to CSOKA and U.S. Pat. No. 4,004,810 to HENRIE. These games employing set partitions, walls, or gates as their main method of providing interest and challenge have limitations based on the unchanging route and/or limited number of routes from one playing of a specific game to the following one. Once the intricacies of the unchanging path or the set number of pathways have been mastered the challenges cease to exist.

In some inventions, there are game boards composed of game board segments or pieces which are fit together to provide multiple routes to move through. These inventions which include many segments require large areas in which to play meaning they have limited paths, and therefore a limited number of different games to play due to reasonable space limitations.

OBJECTS AND ADVANTAGES

Accordingly, several objects and advantages of the present invention are:

(a) to provide a maze game that is intellectually challenging.

(b) to provide a new and novel game apparatus whose playing surface is easily constructed from economical materials so that it can be provided to the consumer at reasonable cost.

(c) to provide a new type of maze game wherein a virtually unlimited number of different mazes are possible and probable.

(d) to provide a game having a game board circumscribing a plurality of spaces, and the board is formed so as to allow the definition of a maze pattern on the game board.

(e) to provide a game wherein partitions or maze walls are removably insertable in the game board and/or placeable on top of the game board.

(f) to provide a game wherein a search piece(s) indicates the position(s) on the game board of the player as a maze is being defined on the game board.

(g) to provide a game wherein certain spaces on the game board send player's search pieces to different places on the game board upon landing on that space.

Other objects and advantages will become apparent to those skilled in the art and the invention will be better understood after reading the following detailed description of the embodiments thereof with reference to the appended drawings, in which:

Figure 1:
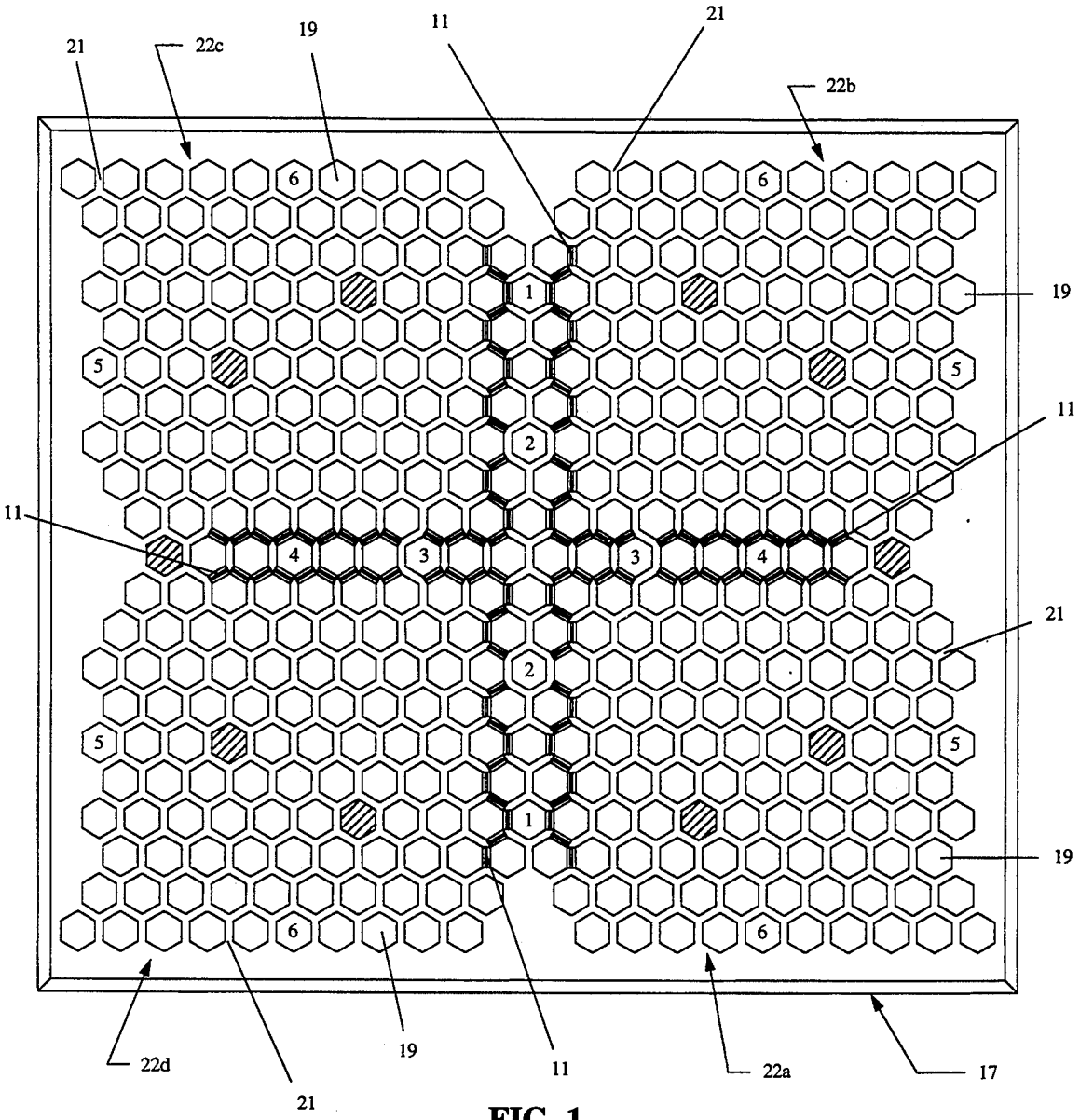
FIG. 1 is a plan view of the game board in the preferred embodiment of the present invention.

While only the preferred form and two alternate forms of the invention are shown it should be understood that various changes or modifications may be made within the scope of the claims attached hereto without departing from the spirit of the invention.

REFERENCE NUMERALS IN DRAWINGS

| | | | |
|---|---|---|---|
| 10 | surface area | 11 | game board maze wall |
| 12 | maze wall | 13 | dice |
| 14 | decoy orb | 15 | marked orb |
| 16 | search piece | 17 | game board |
| 18 | transport space | 19 | movement space |
| 20 | starting space | 20a | starting space one |
| 20b | starting space two | 20c | starting space three |
| 20d | starting space four | 20e | starting space five |
| 20f | starting space six | 21 | maze wall channel |
| 22 | player maze area | 22a | first player's maze area |
| 22b | second player's maze area | 22c | third player's maze area |
| 22d | fourth player's maze area | 23 | maze area entrance |
| 24 | game instruction cards | 25 | game board instructions |

DETAILED DESCRIPTION OF PREFERRED EMBODIMENT

As shown in FIG. 1 through 8, the subject invention is set forth as a game board 17, a pair of dice 13, a plurality of search pieces 16, a plurality of decoy orbs 14, a plurality of marked orbs 15, and a plurality of maze walls 12.

The game board 17 may be constructed of wood, cardboard, pressed paper, metal, plastic composition board, a computer simulated image or any other suitable material. The game board 17 may be of any suitable material provided the essential elements of the invention which are described herein below are included on the game board.

Stamped, printed, painted or otherwise designated on a surface area 10 of the game board 17 has a plurality of hexagonally shaped spaces that are separated by a plurality of maze wall channels 21. There are three different types of spaces on the game board 17; movement spaces 19, starting spaces 20, and transport spaces 18. Indicia means are provided to differentiate the spaces from one another.

The maze wall channels 21 are to be made of sufficient dimensions for the maze walls 12 to be placed in or on. Permanently represented on the game board 17 are game board maze walls 11. The present invention presents game board maze walls 11 as permanently placed; however, this is done for efficiency, and does not mean the game board maze walls 11 could not be represented by maze walls 12 or temporary equivalent. It should be noted the significant difference between game board maze walls 11 and maze walls 12 is that game board maze walls 11 are on the game board 17 before the game begins, and maze walls 12 are placed on the game board 17 as the game is played. Game board maze walls 11 may be stamped, printed, painted, attached and/or otherwise represented on the game board 17.

There are four separate maze areas *22a, 22b, 22c,* and *22d* which are separated be a series of game board maze walls 11. There are a plurality of maze area entrances 23 which are openings into a center oriented pathway which interconnects to all maze areas.

In the preferred embodiment, there are six starting spaces 20 accessible to each maze area which are designated by numbers. Starting spaces *20a, 20b, 20c,* and *20d* are placed equal distant from each maze area in the center pathway between the four maze areas 22. Starting spaces *20e* and *20f* are placed within each maze area for a total of four each.

Figure 3:
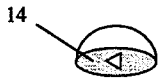
FIG. 3 is a perspective view of a decoy orb piece tilted to show the bottom comprising a preferred embodiment of the present invention.

Referring now to FIG. 3, a decoy orb 14 is shown. The decoy orb 14 has a marking means which is not visible when placed on the game board 17.

Figure 4:
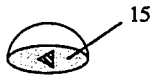
FIG. 4 is a perspective view of a marked orb piece tilted to show the bottom comprising a preferred embodiment of the present invention.

Referring now to FIG. 4, a marked orb 15 is shown. The marked orb 15 has a marking means which is not visible when placed on the game board 17.

Figure 5:
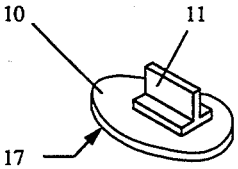
FIG. 5 is an isometric view of a game board maze wall that comprises a preferred embodiment of the present invention.

Referring now to FIG. 5, a game board maze wall 11 is shown. In the preferred embodiment, the game board maze wall 11 is a maze wall 12 permanently attached to the game board 17.

Figure 9:
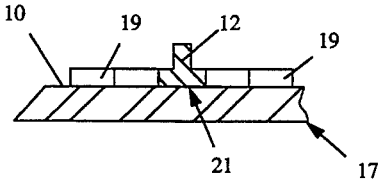
FIG. 9 is a partial section view of a game maze wall between two movement spaces that comprises a preferred embodiment of the present invention.
Figure 6:
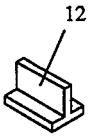
FIG. 6 is an isometric view of a maze wall that comprises a preferred embodiment of the present invention.

Referring now to FIG. 6, a maze wall 12 is shown. In the preferred embodiment, the maze wall is made out of a one piece molded piece of material of a size and proportion to fit in the maze wall channel 21 and is to be self-standing. In FIG. 9, a maze wall 12 is shown placed in a maze wall channel 21 on the game board 17.

Figure 7:
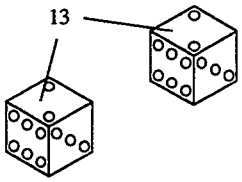
FIG. 7 is an isometric view of a set of dice used as the randomizing element in the preferred embodiment of the present invention.

Referring now to FIG. 7, dice 13 are shown. In the preferred embodiment, two six-sided dice are used.

Figure 8:
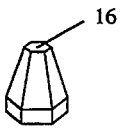
FIG. 8 is a perspective view of a search piece that comprises a preferred embodiment of the present invention.

Referring now to FIG. 8, a search piece 16 is shown. In the preferred embodiment, the search piece 16 is made of a one piece molded material of a size and proportion to fit within the boundaries of the playing spaces (movement spaces 19, starting spaces 20, and transport spaces 18). Each player will have at least one search piece to start the game.

DETAILED OPERATION OF PREFERRED EMBODIMENT

Figure 2:
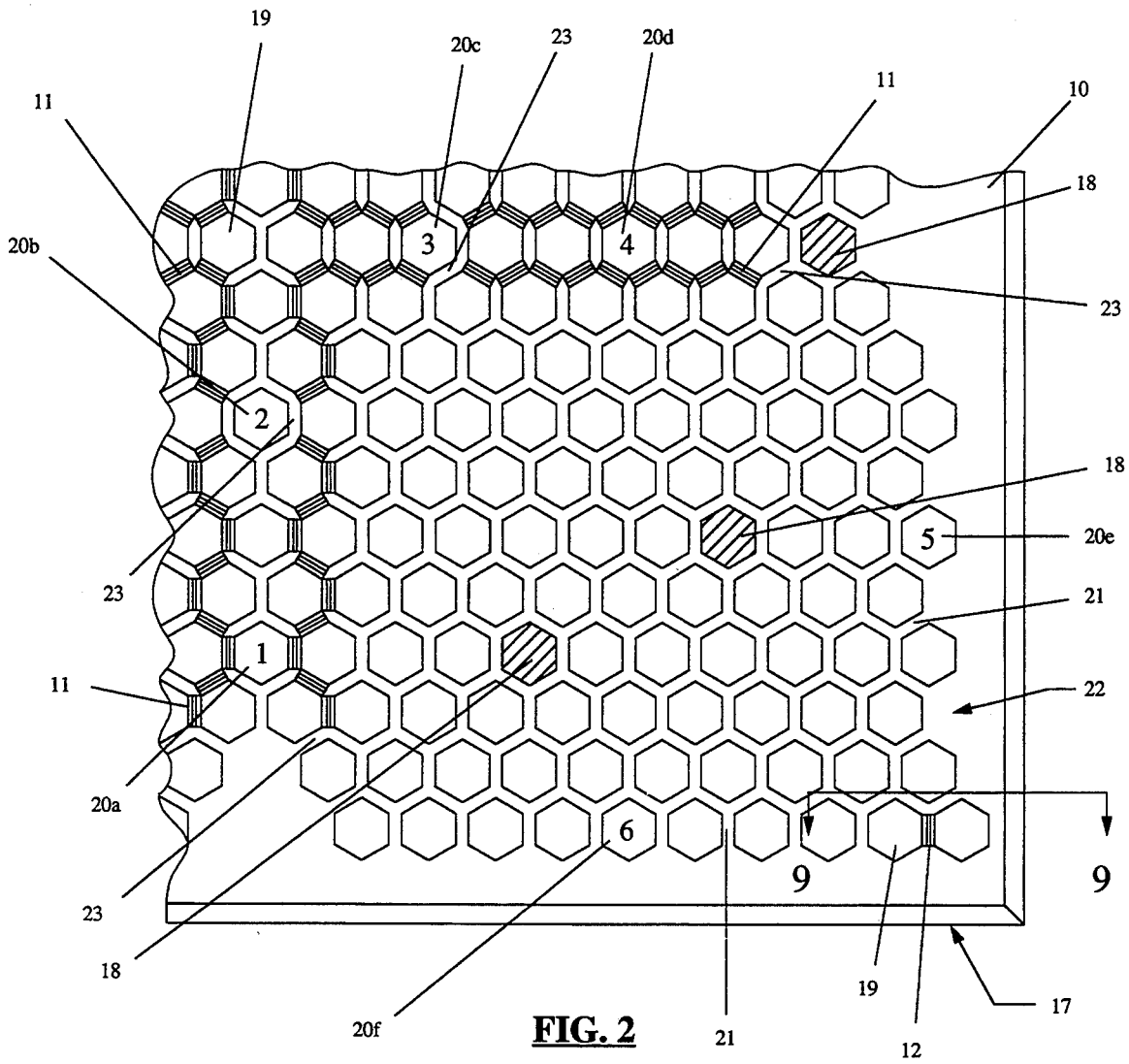
FIG. 2 is an enlarged partial plan view of the game board in the preferred embodiment of the present invention.

Referring now to the operation of the preferred embodiment in FIG. 2, the game begins by each player placing a plurality of decoy orbs 14 and marked orbs 15 in his/or her own maze area 22 on any starting space *20a* through *20f*, transport space 18 and/or movement space 19 while concealing the bottoms of aforesaid orbs. One die 13 is used to determine the starting space *20a* through *20f* that each search piece 16 will start from. Each player's turn starts by rolling in succession dice 13 to determine the number of maze walls 12 the player places in his own maze area 22 in such a manner to provide a path for the other player's search pieces 16 to move on in their search for the marked orbs 15. A set number of maze walls 12 is an alternate choice to rolling dice 13 for determining the number of maze walls 12 used per turn. Placement of the maze walls 12 will be in any maze wall channel 21 with the exception that a continuous path must be available from starting spaces *20a* through *20d* to all the marked orbs 15 in each player's maze area 22 during the course of the game. Starting spaces *20e* and *20f* must be accessible to either the starting spaces *20a* through *20d* or a transport space 18 during the entire course of the game. Each player's turn continues by rolling one die 13 to determine the number of movement spaces 19 and/or starting spaces 20 that a particular search piece 16 will move across. Search pieces 16 that are on starting spaces *20a* through *20f* must enter another player's maze area 22 through a maze area entrance 23. Search pieces 16 only move along a path of adjacent spaces 18, 19 or 20 whose adjacent maze wall channels 21 are vacant of game board maze walls 11 or maze walls 12. When a search piece 16 moves onto a transport space 18 the search piece 16 is transported to a random starting space 20 is determined by a roll of one die 13. A player's own search pieces 16 do not move into a player's own maze area 22. When a search piece 16 moves on a space that is occupied by an orb (a decoy orb 14 or a marked orb 15) the orb is captured and removed from the game board 17. When all of a player's marked orbs 15 have been found/captured that player removes all of his/or her own search pieces 16 from the game board 17 and has lost the game. The game ends when there is only one player with marked orb(s) 15 left in his/or her own maze area 22.

Figure 10:
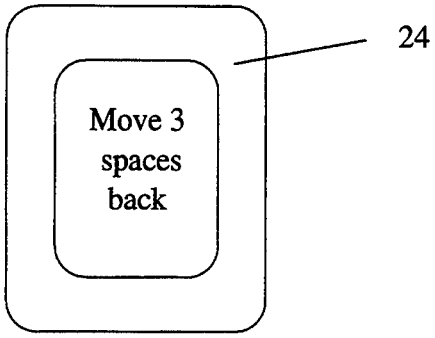
FIG. 10 is a flat view of an instruction card comprising an alternate embodiment of the present invention.
Figure 11:
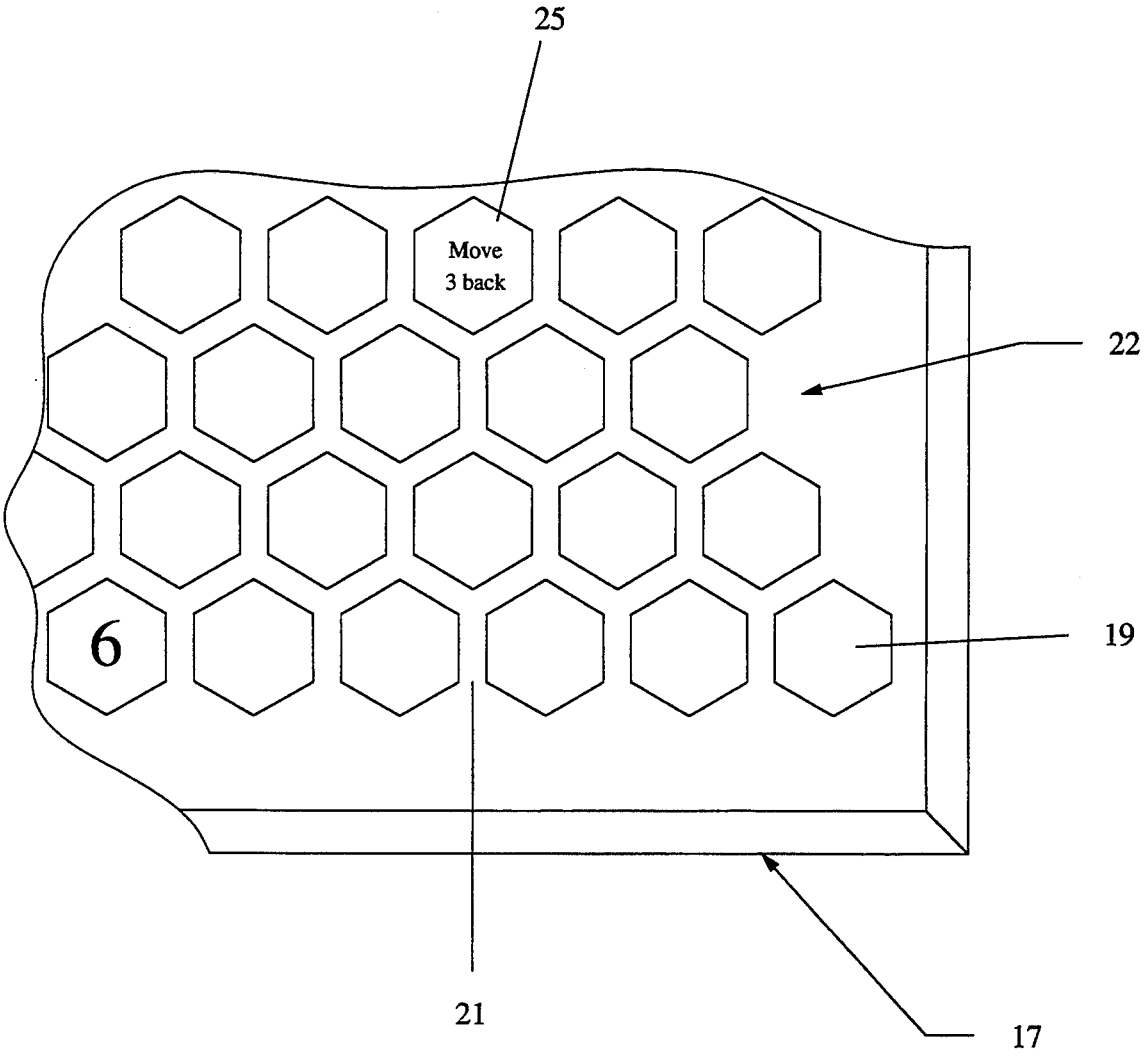
FIG. 11 is an enlarged partial plan view of the game board with indicia comprising an alternate embodiment of the present invention.

While the above describes the preferred embodiment of the invention it is intended that the scope of this invention be limited only by the appended claim. The following alternate embodiments are considered within the scope of the invention and more specifically the claims. The preceding embodiment: referring now to FIG. 10, wherein a set of cards 25 contain instructions thereon regarding movement of search pieces, transport of player's search pieces 16 to spaces on the game board, placement of maze walls 12 and/or procurement of marked orbs 15, which are used during play or when certain game conditions have been met; wherein the starting spaces 20, movement spaces 19, and/or transport spaces 18 are shaped like regular polygons or other consistent definable shape; referring now to FIG. 11 wherein game instructions are inscribed on game board 17 regarding movement of search pieces 16, placement of maze walls 12 and/or procurement of marked orbs 15; wherein marked orbs 15 are worth a determined value toward determining a winner; wherein decoy orbs have differing markings that indicate game instructions or indicia representing game instructions regarding movement; and placement for maze walls 12 and/or procurement of marked orbs 15. It should be appreciated that many variations may be made to this game especially with regard to the number and placement of the spaces (starting spaces 20, movement spaces 19, and/or transport spaces 18), maze walls 12 per turn of play, movement of search pieces 16, and number of decoy orbs 14 and/or marked orbs 15 without departing from the essence of the invention as set forth in the claims. For example numerous space patterns and designs could be used to set up the field of play on the game board 17, and numerous combinations of search pieces 16, marked orbs 15 and/or decoy orbs 14 could be used.

SUMMARY, RAMIFICATIONS AND SCOPE

The subject invention is a maze type game which includes a game board that is comprised of a plurality of spaces (spaces shaped like hexagons in the preferred embodiment) separated by channels wide enough to place maze walls. These walls are to be placed so as to send opponent's search pieces away from the hiding places of one's specially marked orbs. The specially marked orbs are hidden among decoy orbs. Player's search pieces must find the specially marked orbs while not being trapped into a transport space or a blocked passage. Transport spaces are spaces that transport any search piece that moves onto it to a random starting space. Starting spaces are spaces that all search pieces must start, at one time or another. The object of the game is to guide other player's search pieces away from your hidden marked orbs until you are the last player with a marked orb remaining in your maze area.

While this game has very few and very simple rules, the possibilities for a very complicated and challenging game exist. Like chess, this game is only as complicated as the players playing it can make it. The complications will also depend on the player's abilities to organize and think. Unlike many other maze games, this invention provides a game that does not have a set or seen ending. The placement of the orbs, which is unknown to all the other player's, will change continuously from game to game. The wall placement is directly dependent on a player's random movement and random number of maze walls to place on the game board, thus the mazes that are developed on the game board also change continuously from game to game.

This game provides an almost infinite range of playing possibilities. Movement of the search pieces and the number of maze walls each player receives each turn are determined at random thus providing an unpredictable element to the game. As players learn the game they will also learn the vast number of differing strategic possibilities. The main feature that provides that strategic challenge is the transport space. The transport space can be used early in the game to try and get a search piece into the center of a player's maze area to take advantage of the lack of maze walls protecting the decoy and marked orbs to the advantage of the search piece while late in the game it will be used to send search pieces outside the maze area to start again thereby making the player waste time to the advantage of the player placing the maze walls. Each time a search piece is sent out of a maze area, another access to a transport space is used up until finally there is only one path open to the marked orbs.

Although an illustrative embodiment of the present invention is presented here with reference to the accompanying drawings, it is to be understood that the invention is not limited to this precise embodiment, and that changes and modifications may be affected therein by one skilled in the art without departing from the scope or spirit of the invention.

What is claimed is:

1. A maze game for at least two players comprising:

a game board formed with a plurality of means to receive a partition, said means being formed so as to define a playing area divided into at least two segments and areas between said segments, each said segment and said area having a plurality of spaces over which a search piece is moved, said spaces comprising a plurality of starting spaces with an identifying means for a means of determining search piece placement, and a plurality of transport spaces with a transport indicia to indicate that search pieces are to be moved to said starting spaces, a plurality of partitions being formed so as to be removably insertable into said game board means between adjacent spaces within said segments and the area between said segments so the insertable partition is placed therein where a plurality of inserted partitions define a maze on the game board, a plurality of marked elements, each having marked means which is not visible when placed on the game board, each for a particular player and each are searched for by the other player or player's search pieces, a plurality of decoy elements, each having marked means which is not visible when placed on the game board, each having the identical appearance with the exception of the marked means to the marked elements, each for possibly decoying the other player or player's search pieces into moving on to the decoy's elements occupied space, a plurality of individual search pieces, each movable from space-to-space to designate a respective player's position on said game board, a chance means for determining the number of spaces over which a player may move his search piece from space-to-space on said game board.

2. The game of claim 1 further comprising indicia on said game board to indicate starting spaces.

3. The game of claim 2 further comprising indicia on said game board to indicate a numerical order of starting spaces.

4. The game of claim 1 further comprising a plurality of cards having instructions thereon regarding movement of search pieces, placement of maze walls and/or procurement of said marked elements.

5. The game of claim 4 wherein said transport indicia indicates that search pieces are to be moved to spaces as indicated by instructions on said cards.

6. The game of claim 1 further comprising indicia on said game board to identify transport spaces.

7. The game of claim 1 wherein the means to determine movement of a player's search piece from space-to-space is a predetermined number of spaces per turn.

8. The game of claim 1 wherein said game board spaces are shaped into regular polygons.

9. The game of claim 1 wherein said maze areas have at least one entry from said segments between playing areas to all marked elements at all times during play.

10. The game of claim 1 wherein said game board further comprises indicia on said playing spaces indicating instructions regarding movement of search pieces, placement of maze walls and/or procurement of said marked elements.

11. The game of claim 9 wherein said transport indicia indicate that search pieces are to be moved to spaces as said game board.

12. The game of claim 1 wherein said partitions are of a one-piece molded product.

13. The game of claim 1 wherein said game board having a generally planar surface with indicia indicating a playing area divided into a plurality of segments and areas between said segments, each segment and area between said segments having a plurality of spaces over which a search piece is moved.

14. The game of claim 13 wherein said partitions being formed so as to be placeable onto said game board.

15. The game of claim 1 wherein said game board further comprising a plurality of maze areas and a plurality of segments interconnected between said maze areas.

16. The game of claim 1 wherein said game board further comprises of four maze areas and four segments interconnected between said maze areas.

17. The game of claim 1 wherein said transport indicia indicates that search pieces are to be moved to predetermined spaces.

18. The game of claim 1, wherein said marked elements each have marked means which is not visible when placed on the game board, each is worth a plurality of points which is determined by said marked means, and each is searched for by the other player or player's search piece(s).

19. The game of claim 1, wherein said decoy elements each having marked means which is not visible when placed on the game board, each have indicia means to indicate game instructions regarding movement of search pieces, placement for maze walls and/or procurement for said marked elements, each have the identical appearance with the exception of the marked means to the marked elements, and each for decoying the other player or player's search pieces into moving onto the decoy element's occupied space.

* * * * *